US010174446B2

(12) United States Patent
Maehara et al.

(10) Patent No.: US 10,174,446 B2
(45) Date of Patent: Jan. 8, 2019

(54) POLYOLEFIN-BASED ANTISTATIC FIBER, BEING A SINGLE COMPONENT OR A CONJUGATE TYPE FIBER, AND NONWOVEN FABRIC INCLUDING THE SAME

(75) Inventors: Hiroyuki Maehara, Shiga (JP); Shuhei Yoshida, Shiga (JP)

(73) Assignees: JNC CORPORATION, Tokyo (JP); JNC FIBERS CORPORATION, Tokyo (JP)

( * ) Notice: Subject to any disclaimer, the term of this patent is extended or adjusted under 35 U.S.C. 154(b) by 0 days.

(21) Appl. No.: 13/985,044

(22) PCT Filed: Feb. 10, 2012

(86) PCT No.: PCT/JP2012/053738

§ 371 (c)(1),
(2), (4) Date: Aug. 13, 2013

(87) PCT Pub. No.: WO2012/111786

PCT Pub. Date: Aug. 23, 2012

(65) Prior Publication Data

US 2013/0323996 A1 Dec. 5, 2013

(30) Foreign Application Priority Data

Feb. 14, 2011 (JP) ..... 2011-029010

(51) Int. Cl.

| | |
|---|---|
| ***D01F 1/09*** | (2006.01) |
| ***D01F 6/04*** | (2006.01) |
| ***D01F 8/06*** | (2006.01) |
| ***D04H 3/007*** | (2012.01) |

(52) U.S. Cl.

CPC ..... *D04H 3/007* (2013.01); *D01F 1/09* (2013.01); *D01F 6/04* (2013.01); *D01F 8/06* (2013.01); *Y10T 428/2929* (2015.01); *Y10T 442/659* (2015.04); *Y10T 442/696* (2015.04)

(58) Field of Classification Search

CPC ..... D01F 8/06; D01F 1/02; D01F 1/09; D01F 6/04; D04H 3/007; Y10S 57/901

USPC ..... 442/361–365

See application file for complete search history.

(56) References Cited

U.S. PATENT DOCUMENTS

| | | | | |
|---|---|---|---|---|
| 3,190,763 | A * | 6/1965 | Schleede et al. | 106/200.1 |
| 6,015,617 | A * | 1/2000 | Maugans | C08L 23/06 428/364 |
| 6,022,935 | A | 2/2000 | Fischer et al. | |
| 6,811,716 | B1 | 11/2004 | Stengaard et al. | |
| 2002/0161123 | A1* | 10/2002 | Li et al. | 525/178 |
| 2005/0164586 | A1* | 7/2005 | Autran et al. | 442/361 |

FOREIGN PATENT DOCUMENTS

| | | |
|---|---|---|
| JP | 08-174737 | 7/1996 |
| JP | 10-024540 | 1/1998 |
| JP | 2003-226354 | 8/2003 |
| JP | 2003-313724 | 11/2003 |
| JP | 2005-194433 | 7/2005 |
| JP | 2005-239242 | 9/2005 |
| JP | 2007-262409 | 10/2007 |
| JP | 2008-156396 | 7/2008 |
| JP | 3143726 | 7/2008 |
| JP | 2009-173510 | 8/2009 |

OTHER PUBLICATIONS

Rana, S.K., "Blend of high-density polyethylene and a linear low-density polyethylene with compositional-invariant mechanical properties," Jan. 8, 2002, Journal of Applied Polymer Science, vol. 83, issue 12, pp. 2604-2608.*

"1st Office Action of China Counterpart Application", dated Sep. 9, 2014, p. 1-p. 8.

Hu et al, "Polyolefin Functionalization and Modification", with English translation thereof, Chemical Industry Press, Mar. 2006, p. 370-371.

Wu et al., "Polymer Blending and Modification", with English translation thereof, China Light Industry Publishing House, Feb. 1996, p. 178-180.

"Office Action of China Counterpart Application", dated Apr. 9, 2015, p. 1-p. 6.

"Office Action of China Counterpart Application", with partial English translation thereof, dated Sep. 11, 2015, p. 1-p. 10.

"Office Action of China Counterpart Application" with English translation, dated Feb. 15, 2016, p. 1-p. 17.

"Office Action of Korea Counterpart Application," dated Feb. 12, 2018, with English translation thereof, p. 1-p. 12.

Masterbatches Catalog, 2006, p. 22, Tokyo Printing Ink Mfg. Co., Ltd. with partial English translation thereof.

"Written Opinion of the International Searching Authority (Form PCT/ISA/237)", dated Jan. 9, 2013, p. 1-p. 3, in which two of the listed references (U.S. Pat. No. 6,811,716, U.S. Pat. No. 6,022,935) were cited.

"International Search Report (Form PCT/ISA/210)", dated Jan. 9, 2013, pp. 1-4, in which two of the listed references (U.S. Pat. No. 6,811,716, U.S. Pat. No. 6,022,935) were cited.

* cited by examiner

*Primary Examiner* — Peter Y Choi
(74) *Attorney, Agent, or Firm* — JCIPRNET

(57) ABSTRACT

A polyolefin-based antistatic fiber, wherein a polyethylene resin com¬position containing polyethylene resin (A) obtained using a metal-locene catalyst and high molecular antistatic agent (B) forms a fiber surface, and the total amount (at 90° C. for 30 minutes) of volatile organic compounds having up to 20 carbon atoms is 10 ug/g or less. The polyolefin-based antistatic fiber may be in the form of a sheath-core type conjugate fiber in which the polyolefin resin composition forms the sheath. A nonwoven fabric formed from the polyolefin-based antistatic fiber, preferably having a defined surface resistance value, as well as a composite nonwoven fabric and formed body obtained using the nonwoven fabric are further disclosed.

14 Claims, No Drawings

POLYOLEFIN-BASED ANTISTATIC FIBER, BEING A SINGLE COMPONENT OR A CONJUGATE TYPE FIBER, AND NONWOVEN FABRIC INCLUDING THE SAME

CROSS-REFERENCE TO RELATED APPLICATION

This application is a 371 application of an international PCT application serial no. PCT/JP2012/053738, filed on Feb. 10, 2012, which claims the priority benefit of Japan application no. 2011-029010, filed on Feb. 14, 2011. The entirety of each of the abovementioned patent applications is hereby incorporated by reference herein and made a part of this specification.

TECHNICAL FIELD

The present invention relates to a fiber including a specific polyethylene resin composition containing a high molecular antistatic agent, a nonwoven fabric including the fiber, and a formed body including the nonwoven fabric. More particularly, the invention relates to a nonwoven fabric with generating only a small amount of volatile organic compounds, having a semipermanent antistatic property, an excellent spinnability, and suitable to be used as a packaging material, particularly for electronic materials, or the like.

BACKGROUND ART

Conventionally, paper such as a corrugated board has been used as a cushioning material or a packaging material for transport. In recent years, a material generating neither paper dust nor volatile organic compounds has been required for the cushioning material or the packaging material for transporting glass plates used for flat panel displays for liquid crystal televisions or plasma televisions, precision electronic components or the like. Thus, a sheet formed of a polyolefin-based resin (Patent literature No. 1 as described below) and a foamed sheet formed of a polyolefin-based resin (Patent literatures No. 2, 3 and 4 as described below) have been proposed.

Moreover, considering a demand for preventing deposition of dirt and dust due to static electricity during packaging and transport, a cushioning material where an antistatic agent is kneaded into a polyolefin-based resin foamed sheet itself (Patent literatures No. 5 and 6 as described below), and a packaging material on which a polyolefin-based resin film containing a high molecular antistatic agent is laminated (Patent literature No. 7 as described below) have been proposed.

However, a problem exists in that low-molecular-weight volatile components contained in the polyolefin-based resin are transferred onto an article to be packed to cause contamination and affect the glass plates or the precision electronic components. The antistatic agent is unable to address this because the antistatic agent is trapped in a foamed air layer. Moreover, the foamed sheet takes up much space during transportation because the sheet is thick.

As a thinned product, use of a thin nonwoven fabric sheet formed of a polyester continuous fiber has been proposed in which heat embossing is applied and a contact area ratio is decreased (Patent literature No. 9). However, when a polyester is used for a fiber, a sufficient antistatic effect is not obtained because melting at a high temperature is necessary, and consequently decomposition of the antistatic agent easily occurs.

Moreover, an antistatic sheet limited to a specific polypropylene resin from a stand point of compatibility of a polymer antistatic agent has been proposed for transporting electronic components (Patent literature No. 8).

However, the resin as proposed in Patent literature No. 8 is a high viscosity resin intended for a sheet or a film, and hence cannot be used for a fiber. If the resin is used for the fiber, a sufficient antistatic effect is not obtained because melting at a high temperature is necessary, and consequently decomposition of the antistatic agent occurs.

In a high molecular resin such as the polyolefin-based resin, generally (refer to Non-patent literature No. 1), an antistatic effect tends to become harder to obtain as density increases in order of low density polyethylene (LDPE), linear low density polyethylene (LLDPE) and high density polyethylene (HDPE). Therefore, only a small number of products are constituted of a high density polyethylene resin, particularly, among formed products obtained from the polyolefin-based resin.

CITATION LIST

Patent Literature

Patent literature No. 1: JP 2003-226354 A.
Patent literature No. 2: JP 2005-239242 A.
Patent literature No. 3: JP H8-174737 A.
Patent literature No. 4: JP H10-24540 A.
Patent literature No. 5: JP 2007-262409 A.
Patent literature No. 6: JP 2005-194433 A.
Patent literature No. 7: JP 3143726 Y.
Patent literature No. 8: JP 2008-156396 A.
Patent literature No. 9: JP 2009-173510 A.

Non-patent Literature

Non-patent literature No. 1: Tokyo Printing Ink Mfg. Co., Ltd., Masterbatches Catalog (2006. 5. 6K).

SUMMARY OF INVENTION

Technical Problem

A subject of the invention is to provide a nonwoven fabric suitable for transport and packaging in which an effect of an antistatic agent is exhibited effectively, neither dirt nor dust is deposited, and volatile components are small, a fiber for constituting the same, and a formed body using the nonwoven fabric.

Solution to Problem

The inventors of the invention have diligently continued research for solving the problem. As a result, they have found that use of a resin composition in which a specific polyolefin resin and a specific antistatic agent are formulated has resulted in an excellent spinnability at a high speed for obtaining a single component fiber or a sheath-core type conjugate fiber, and obtaining a nonwoven fabric having a semipermanent antistatic performance, and thus have completed the invention. The semipermanent antistatic performance means that an antistatic effect lasts semipermanently from the time immediately after forming, and hardly changes even by water washing, and that humidity dependence is small, and antistaticity is demonstrated even under a low humidity. Here, "an antistatic effect lasts semipermanently" signifies that the antistatic effect lasts stably for a long time.

More specifically, the invention includes the following items.

(1) A polyolefin-based antistatic fiber, wherein a polyethylene resin composition containing polyethylene resin (A) obtained using a metallocene catalyst and high molecular antistatic agent (B) forms a fiber surface, and the total amount (at 90° C. for 30 minutes) of volatile organic compounds having up to 20 carbon atoms is 10 μg/g or less.

(2) The polyolefin-based antistatic fiber according to the item (1), wherein polyethylene resin (A) is a high density polyethylene having a density of 0.94 to 0.97 g/cm$^3$.

(3) The polyolefin-based antistatic fiber according to the item (1) or (2), wherein a melt index (at 190° C. under 2.16 kg load) of polyethylene resin (A) is 10 to 100 g/10 minutes.

(4) The polyolefin-based antistatic fiber according to any one of the items (1) to (3), wherein the polyethylene resin composition further contains 5 to 20 parts by weight of at least one kind of low density polyethylene resin (C) selected from low density polyethylene resin (c1) obtained using a metallocene catalyst and having a melt index (at 190° C. under 2.16 kg load) of 10 to 100 g/10 minutes and a density of 0.87 to 0.92 g/cm$^3$, and linear low density polyethylene resin (c2) obtained using the metallocene catalyst and having a melt index (at 190° C. under 2.16 kg load) of 10 to 100 g/10 minutes and a density of 0.91 to 0.94 g/cm$^3$ based on 100 parts by weight of polyethylene resin (A).

(5) The polyolefin-based antistatic fiber according to any one of the items (1) to (4), wherein the polyolefin-based antistatic fiber is a sheath-core type conjugate fiber in which the polyethylene resin composition forms a sheath component completely covering the fiber surface.

(6) The polyolefin-based antistatic fiber according to the item (5), wherein a core component contains 100 parts by weight of high density polyethylene resin (D) obtained using a metallocene catalyst or Ziegler-Natta catalyst and having a melt index (at 190° C. under 2.16 kg load) of 10 to 100 g/10 minutes and a density of 0.94 to 0.97 g/cm$^3$, and 5 to 20 parts by weight of at least one kind of low density polyethylene resin (E) selected from low density polyethylene resin (e1) obtained using the metallocene catalyst or Ziegler-Natta catalyst and having a melt index (at 190° C. under 2.16 kg load) of 10 to 100 g/10 minutes and a density of 0.87 to 0.92 g/cm$^3$, and linear low density polyethylene resin (e2) obtained using the metallocene catalyst or Ziegler-Natta catalyst and having a melt index (at 190° C. under 2.16 kg load) of 10 to 100 g/10 minutes and a density of 0.91 to 0.94 g/cm$^3$.

(7) The polyolefin-based antistatic fiber according to any one of the items (5) to (6), wherein a melting point of the core component is higher than a melting point of the sheath component by 10° C. or more in the melting point measured at a heating rate of 10° C./minute by means of a differential scanning calorimeter (DSC).

(8) The polyolefin-based antistatic fiber according to any one of the items (1) to (7), wherein high molecular antistatic agent (B) is mixed in a ratio of 5 to 30 parts by weight based on 100 parts by weight of polyethylene resin (A).

(9) The polyolefin-based antistatic fiber according to any one of the items (1) to (8), wherein the fiber is a continuous fiber.

(10) The polyolefin-based antistatic fiber according to the item (9), wherein the fiber is manufactured by any one of a manufacturing method, selected from a spunbond method or a meltblown method.

(11) A nonwoven fabric obtained using the fiber according to any one of the items (1) to (10).

(12) The nonwoven fabric according to the item (11), wherein a surface resistance value of the nonwoven fabric is in the range of $10^3$ to $10^{13}\Omega$.

(13) A composite nonwoven fabric, wherein any of other layers is laminated on the nonwoven fabric according to the item (11) or (12).

(14) A formed body obtained using the nonwoven fabric according to the item (11) or (12) or the composite nonwoven fabric according to the item (13).

Advantageous Effects of Invention

An antistatic nonwoven fabric obtained from an antistatic fiber of the invention and a formed body constituted thereof are characterized by having an excellent antistaticity and generating only a small amount of volatile organic compounds. Moreover, because the spinnability of the fiber constituting the nonwoven fabric is excellent, a uniform and thin fiber is obtained and a thin and strong nonwoven fabric is obtained. Therefore, the nonwoven fabric of the invention and the formed body constituted thereof can be used suitably for transporting glass plates for liquid crystal panels and electronic components that deteriorated by deposition of dirt and dust without taking up much space. As for the fiber of the invention and the nonwoven fabric obtained using the fiber, spinnability is satisfactory, in addition to reduction of generation of the volatile organic compounds due to selection of a suitable material. Therefore, the fiber is not required to be spun at a high temperature at which an added high molecular antistatic agent is decomposed. Thus, reduction of surface fouling on textiles obtained and spinning and processing at a low temperature are allowed. Then, combined with another effect that a risk such as generation of a decomposition product due to decomposition of additives such as the high molecular antistatic agent is eliminated, achievement of an unprecedented low VOC value, and provision and stable production of a sheet maintaining the low VOC value are allowed.

According to the invention, moreover, strength and a surface resistance value of the fiber can be adjusted upon request particularly by processing the fiber into the sheath-core type (concentric sheath-core or eccentric sheath-core type) conjugate fiber, and the nonwoven fabric having an excellent versatility including performance and cost can be provided.

DESCRIPTION OF EMBODIMENTS

An antistatic fiber of the invention and a nonwoven fabric including the fiber include a polyolefin-based antistatic fiber in which a polyethylene resin composition containing high molecular antistatic agent (B) in polyethylene resin (A) obtained using a metallocene catalyst forms a fiber surface and the total amount (at 90° C. for 30 minutes) of volatile organic compounds having up to 20 carbon atoms is 10 μg/g or less, and the nonwoven fabric including the fiber.

Hereinafter, the invention will be explained in detail.

As for polyethylene resin (A) intended for use in the polyethylene resin composition of the invention, a polyethylene polymerized by using the metallocene catalyst is used in view of a low VOC value being achieved, deposition of the volatile organic compounds on an article to be packed can be suppressed, and no stickiness on the fiber surface occurs because the polyethylene contains only a small amount of volatile organic compounds (both nonpolar components and polar components). As for polyethylene resin (A), furthermore, a high density polyethylene having a density of 0.94 to 0.97 g/cm$^3$, particularly, 0.95 to 0.96 g/cm$^3$ is preferable in view of feeling and strength of the fiber. Moreover, polyethylene resin (A) of the invention has preferably a melt index measured at 190° C. under 2.16 kg load (hereinafter, abbreviated as MI) of 10 to 100 g/10 minutes, further preferably, 15 to 100 g/10 minutes in view of spinning a thin fiber at a high speed.

In view of obtaining the thin fiber at a high speed, moreover, the polyethylene resin composition preferably contains 5 to 20 parts by weight of at least one kind of low density polyethylene resin (C) selected from low density polyethylene resin (c1) obtained using the metallocene catalyst and linear low density polyethylene resin (c2) obtained using the metallocene catalyst, based on 100 parts by weight of polyethylene resin (A). For this purpose, as low density polyethylene resin (c1), use of a product having a MI of 10 to 100 g/10 minutes, preferably, 15 to 100 g/10 minutes, and a density of 0.87 to 0.92 g/cm$^3$, preferably, 0.91 to 0.92 g/cm$^3$ is preferable, and a homopolymer of ethylene or a copolymer with an α-olefin having 3 to 12 carbon atoms based essentially on ethylene can be used. Moreover, as linear low density polyethylene resin (c2), use of a product having a MI of 10 to 100 g/10 minutes, preferably, 15 to 100 g/10 minutes, and a density of 0.91 to 0.94 g/cm$^3$, preferably, 0.91 to 0.93 g/cm$^3$ is preferable, and a homopolymer of ethylene or a copolymer with an α-olefin of 3 to 12 carbon atoms based essentially on ethylene can be used. In addition, also in the case of allowing low density polyethylene resin (C) to be contained in polyethylene resin (A), independently of polyethylene resin (C), polyethylene resin (A) preferably has the embodiment as described above (polyethylene resin (A) may be the high density polyethylene polymerized using the metallocene catalyst and having a density of 0.94 to 0.97 g/cm$^3$ (particularly, 0.95 to 0.96 g/cm$^3$), or a MI of 10 to 100 g/10 minutes (particularly, 15 to 100 g/10 minutes)).

As for the polyethylene resin composition used in the invention, MI of components excluding the high molecular antistatic agent (B) is preferably in the range of 10 to 100 g/10 minutes. If MI is 10 g/10 minutes or more, viscosity is kept in a low range suitable for high-speed spinnability, and suitable for obtaining the thin fiber. On the other hand, if MI is 100 g/10 minutes or less, fiber strength is kept high, the fiber does not become brittle, the amount of smoke components (volatile organic compounds) during melt extrusion can be suppressed, and no smoke components deposit on the fiber. More specifically, if MI is in the range of 10 to 100 g/10 minutes, high-speed spinnability is satisfactory, the thin fiber is easily obtained and the amount of smoke components during melt extrusion is decreased. Thus, the smoke components are unlikely to deposit on the fiber, and a decrease in fiber strength is also small, and therefore the range is preferable.

In the invention, the fiber in which the polyethylene resin composition forms the fiber surface is manufactured, and the nonwoven fabric using the resultant fiber is manufactured. The nonwoven fabric obtained is used effectively as a packaging sheet for electronic materials for which a film or a sheet has been used conventionally, or the like.

In general, a resin used for manufacturing the film or the sheet has a higher viscosity, as compared with a resin used for manufacturing the fiber. More specifically, as compared with manufacturing the fiber (spinning), fabrication at a higher temperature ordinarily is needed, the smoke components generated during processing for molding easily deposit on a product surface, and a risk of increasing a VOC value due to weight loss on heating of additives is possibly unavoidable. Thus, an approach aimed at the fiber formed generally under milder forming conditions in place of such a film and sheet and the nonwoven fabric obtained using the fiber can be a fundamentally effective means for achieving the low VOC value and stably supplying sheets at the low VOC value. Moreover, in order to ensure the strength, which is apt to be poor generally by processing the fiber of the invention into the nonwoven fabric, the high density polyethylene is preferably used as an component for forming the fiber surface according to the invention. Then, the exhibiting of antistaticity tends to be harder with an increase of density of the resin to be used. Therefore, an antistatic effect can be compensated by increasing a surface area in consequence of a nonwoven fabric having structure where fine fibers are densely accumulated.

Herein, an expression "fiber in which the polyethylene resin composition containing polyethylene resin (A) and high molecular antistatic agent (B) forms the fiber surface" means both "fiber in which the polyethylene resin composition forms at least part of the fiber surface," and "fiber in which the polyethylene resin composition forms at least the fiber surface." More specifically, the expression means a conjugate fiber in which the polyethylene resin composition forms only part of the fiber surface, a conjugate fiber in which the polyethylene resin composition wholly forms the fiber surface, and a single component fiber in which the polyethylene resin composition forms both the fiber surface and an inside of the fiber. Among the fibers, the conjugate fiber in which the polyethylene resin composition forms 50% or more of the fiber surface is preferable, and the sheath-core type (concentric sheath-core or eccentric sheath-core type) conjugate fiber in which the polyethylene resin composition covers the fiber surface completely as a sheath component is particularly preferable. Depending on the applications, the single component fiber in which the polyethylene resin composition forms both the fiber surface and the inside of the fiber is also preferable.

When the polyolefin-based antistatic fiber of the invention is the conjugate fiber, the invention is not limited only to the sheath-core type as described above, but also includes an embodiment in which the polyethylene resin composition forming the fiber surface does not completely cover the fiber surface (an embodiment in which part of the other component of the conjugate fiber is exposed on the fiber surface, for example, a side-by-side type conjugate fiber).

Thus, as for the fiber of the invention and the nonwoven fabric obtained using the fiber, in addition to the reduction of the volatile organic compounds generated due to selection of a suitable material, reduction of surface fouling on textiles obtained and spinning and processing at a low temperature due to improvement of formability (spinnability) are allowed. Then, combined with another effect that a risk such as generation of a decomposition product due to decomposition of additives is eliminated, achievement of an unprecedented low VOC (Volatile Organic Compound) value, and provision and stable production of the sheet maintaining the low VOC value are allowed.

As for high molecular antistatic agent (B) used in the invention, the decomposition start temperature thereof is preferably equal to or higher than temperature at which polyethylene resin (A) can be spun in order that the performance of an antistatic agent is not adversely affected.

Moreover, high molecular antistatic agent (B) is preferably polyethers having a hydrophilic group and being subjected to block copolymerization. Specific examples of commercially available high molecular antistatic agent (B) include "Pelestat" and "Pelectron" (trade names) made by Sanyo Chemical Industries, Ltd., Sankonol (trade name) made by Sanko Chemical Ind. Co., Ltd., "Entira AS" (trade name) made by Du Pont-Mitsui Polychemicals Co., Ltd., "Pebax" (trade name) made by Arkema, Inc. and "Stat-Rite" (trade mark) made by Lubrizol Corporation. The high molecular antistatic agents as described above may be used alone or in combination. As for the amount of mixing the antistatic agent, 5 to 30 parts by weight, preferably, 10 to 20 parts by weight of the antistatic agents are mixed based on 100 parts by weight of polyethylene resin (A), and thus a surface resistance value of the nonwoven fabric constituted of the fiber can be adjusted in the range of $10^3$ to $10^{13}\Omega$, preferably, in the range of $10^6$ to $10^{12}\Omega$. The technical term "high molecular antistatic agent" is well known by persons skilled in the art and thus definite. Persons skilled in the art easily can recognize and use any compounds classified by the technical term.

In addition to the high molecular antistatic agent as described above, additives may be appropriately added, when necessary, in the polyethylene resin composition used in the invention within the range where advantageous effects of the invention are not adversely affected. As the additives to be added, a coloring agent, an antioxidant, a weathering-resistant agent, a light stabilizer, an antibacterial agent, a dispersant, a crystal nucleating agent, a flame retardant, a metal deactivator, an inorganic filler for giving rigidity or the like may be used, and resin components other than the polyolefin-based resin may be contained within the range where advantageous effects of the invention are not adversely affected.

The fiber used in the invention may be the single component fiber formed of the polyethylene resin composition as described above, or the conjugate fiber in which the polyethylene resin composition as described above forms the fiber surface. In particular, the sheath-core type conjugate fiber as described above in which the polyethylene resin composition completely covers the fiber surface as the sheath component is preferable in view of easily demonstrating an antistatic performance. In view of high-speed spinning at a low temperature, the core component preferably contains 100 parts by weight of high density polyethylene resin (D) obtained using the metallocene catalyst or Ziegler-Natta catalyst and having a MI of 10 to 100 g/10 minutes, preferably, 15 to 80 g/10 minutes, and a density of 0.94 to 0.97 g/cm$^3$, preferably, 0.95 to 0.96 g/cm$^3$, and 5 to 20 parts by weight of at least one kind of low-density polyethylene resin (E) selected from low-density polyethylene resin (e1) and linear low density polyethylene resin (e2). For this purpose, as low density polyethylene resin (e1), use of a product obtained using the metallocene catalyst or Ziegler-Natta catalyst and having an MI of 10 to 100 g/10 minutes, preferably, 15 to 80 g/10 minutes, and a density of 0.87 to 0.92 g/cm$^3$, preferably, 0.91 to 0.92 g/cm$^3$ is preferable, and a homopolymer of ethylene or a copolymer with an α-olefin of 3 to 12 carbon atoms based essentially on ethylene can be used. Moreover, as linear low density polyethylene resin (e2), use of a product obtained using the metallocene catalyst or Ziegler-Natta catalyst and having a MI of 10 to 100 g/10 minutes, preferably, 15 to 80 g/10 minutes, and a density of 0.91 to 0.94 g/cm$^3$, preferably, 0.91 to 0.93 g/cm$^3$ is preferable, and a homopolymer of ethylene or a copolymer with an α-olefin of 3 to 12 carbon atoms based essentially on ethylene can be used. Also in the case where the conjugate fiber is not the sheath-core type but has an embodiment where at least part of one of components of the conjugate fiber is exposed on the fiber surface (a side-by-side type conjugate fiber, for example), the one of component of the conjugate fiber is preferably same with the core component.

In the fiber used in the invention, moreover, a polypropylene resin polymerized using the metallocene catalyst or Ziegler-Natta catalyst can be used as the core component of the sheath-core type conjugate fiber in view of heat resistance and dimensional stability.

The conjugate fiber of the invention preferably has the core component based essentially on high density polyethylene resin (D), as compared with the core component based essentially on the polypropylene resin as described above, in view of environmental load reduction (ease of recycling).

In the sheath-core type polyolefin conjugate fiber of the invention, a melting point of the core component is preferably higher than a melting point of the sheath component by 10° C. or more in the melting point measured at a heating rate of 10° C./minute by means of DSC. When a difference in melting point is less than 10° C., the core component melts and maintenance of a fiber form tends to become difficult.

A ratio of the core component to the sheath component (core component/sheath component) is preferably in the range of 90/10 to 10/90 in terms of a weight ratio in view of reinforcing rigidity of the fiber. The ratio is further preferably in the range of 70/30 to 50/50.

In measuring the volatile organic compounds (VOC) in accordance with VDA 278 (Standards of the German Association of the Automotive Industry: Verband der Automobilindustrie), the total amount of VOC of the fiber used in the invention is 10 μg/g or less, preferably, 5 μg/g or less. If the total amount of VOC exceeds 10 μg/g, volatile components are deposited on an article to be packed or the like, and the influence on a product is a concern.

As a method for measuring VOC, 30 mg of fiber or nonwoven fabric is directly put in a glass tube of a thermal desorption device in accordance with VDA 278, and heated at 90° C. for 30 minutes, and then the total amount of VOC is obtained by measuring the volatile components emitted upon heating up to 20 carbon atoms by means of a gas chromatograph-mass spectrometer.

The antistatic fiber of the invention is preferably a continuous fiber. As compared with a nonwoven fabric including a short fiber, a constitution of the continuous fiber allows significant reduction in density of the existence of end faces of the fiber in the nonwoven fabric, and effectively deprives the nonwoven fabric of base points of volatilization of organic compounds in the fiber. The continuous fiber is particularly preferably obtained by a spunbond method or a meltblown method. The spunbond method or the meltblown method is a manufacturing method for directly obtaining the nonwoven fabric, and does not include a step for depositing a fiber treatment agent or the like onto the fiber surface in a step up to processing the fiber into the nonwoven fabric. Therefore, stable production of sheets at the low VOC value is allowed efficiently.

The nonwoven fabric of the invention is manufactured by melting the polyethylene resin composition or the like by means of an extruder, spinning the single component fiber or the sheath-core type conjugate fiber continuously from a spinneret, and performing thermocompression bonding.

More specifically, the polyethylene resin composition as described above and so forth are mixed with additives, when necessary, and melted by means of the extruder to discharge the melt from the spinneret for obtaining the single component fiber, and a web is formed according to the spunbond method for allowing melt stretching and then accumulating the continuous fiber on a conveyor by means of an air sucker, or according to the meltblown method for allowing melt stretching and then accumulating the continuous fiber on a conveyor by means of a hot air jet, and then the nonwoven fabric can be manufactured by bonding the continuous fibers with each other by means of an embossing roll set at 100 to 140° C. or the like.

Moreover, each resin composition of the sheath component and the core component is melted by means of each extruder to discharge the melt from a spinneret for obtaining the sheath-core type conjugate fiber, and to accumulate the continuous fibers according to the spunbond method or the meltblown method, and then the nonwoven fabric can be manufactured by bonding the fibers with each other by means of an embossing roll set at 100 to 140° C. or the like.

Another nonwoven fabric of the invention may be laminated on the nonwoven fabric of the invention, or any of other layers different from the nonwoven fabric of the invention may be laminated to be processed into a composite nonwoven fabric. Specific examples of any of other layers (herein after abbreviated as "second layer") include a nonwoven fabric in which the short fibers are thermally bonded by means of hot air, a nonwoven fabric in which the short fibers are entangled by means of hydraulic pressure, a nonwoven fabric in which the short fibers are entangled by means of a steam jet, a meltblown nonwoven fabric, a spunbond nonwoven fabric and a polyolefin resin sheet without being limited thereto.

The nonwoven fabric obtained from the fiber of the invention can be used for a dustproof cover nonwoven fabric of OA equipment (office automation equipment [electronic device]), a protective nonwoven fabric for clean room instruments, a protective nonwoven fabric for medical equipment, or the like, besides as a packaging material nonwoven fabric for electronic materials, such as electronic products, silicon semiconductors, and glass substrates for displays.

The nonwoven fabric or the composite nonwoven fabric obtained according to the invention can be processed into a formed body by means of vacuum forming, pressure forming, matched mold forming or the like. Thermoforming by heating also can be applied. Specific examples of the formed bodies include a cushioning material, a carrier tape, an article storage case, a food container and a tray.

EXAMPLES

In the following, the invention will be explained more specifically by way of Examples, but the invention is in no way limited to the Examples.

Measurement methods and evaluation methods used in the invention are shown below.

(1) Melt index (MI): Measurements were carried out at a temperature of 190° C. under a load of 2.16 kgf in accordance with JIS K6760. Unit: g/10 minutes.

(2) Melting point: A differential scanning calorimeter (DSC) made by TA instruments, Inc. was used. A sample was heated from room temperature to 230° C. at a heating rate of 10° C./minute, held at the temperature for 5 minutes, and then cooled to 30° C. at a cooling rate of 10° C./minute, and heated again at a heating rate of 10° C./minute. The endothermic melting temperature was measured as a melting point. Unit: ° C.

(3) Spinnability: Melt spinning was conducted from a spinneret having 100 spinning holes with a spinning hole diameter of 0.5 millimeter at a discharge rate of 0.28 g/minute-hole at a resin temperature of 230° C., and the resulting fiber was taken up by means of an air sucker at speed equivalent to 2,500 m/minute, and the number of times of yarn breakage for 30 minutes was measured.

(4) Nonwoven fabric strength: A maximum tenacity was measured upon pulling a nonwoven fabric at a tension speed of 100 mm/minute and a distance of 100 millimeters between samples in a direction of taking up the nonwoven fabric (length direction) by using a tensile tester (Autograph AGS-1kNJ machine) made by Shimadzu Corporation. Unit: N.

(5) Surface resistance: A surface resistance value of a nonwoven fabric after 24 hours from forming the nonwoven fabric under an atmosphere of 25° C. and 50% humidity was measured using a surface resistance meter (Simco Japan Inc., Worksurface Tester ST-3). Unit: Ω.

(6) VOC: The total concentration of volatile components up to 20 carbon atoms generated from a product by heating at 90° C. for 30 minutes was measured by means of a headspace gas chromatograph-mass spectrometer (Clarus 600 GC/MS & TurboMatrix Trap 40) in accordance with VDA 278. Unit: μg/g.

Material Used

Polyethylene resin 1: Metallocene catalyst system, high density polyethylene.

"CREOLEX QR603A" made by Asahi Kasei Corporation.

(MI=27 g/10 minutes, density=0.96 g/cm$^3$, melting point=132° C.)

Polyethylene resin 2: Metallocene catalyst system, high density polyethylene.

"CREOLEX QR600B" made by Asahi Kasei Corporation.

(MI=100 g/10 minutes, density=0.96 g/cm$^3$, melting point=132° C.).

Polyethylene resin 3: Metallocene catalyst system, high density polyethylene.

"CREOLEX QT4750" made by Asahi Kasei Corporation.

(MI=5 g/10 minutes, density=0.96 g/cm$^3$, melting point=130° C.).

Polyethylene resin 4: Ziegler catalyst system, high density polyethylene.

"Suntec HD J302" made by Asahi Kasei Corporation.

(MI=42 g/10 minutes, density=0.96 g/cm$^3$, melting point=132° C.).

Polyethylene resin 5: Ziegler catalyst system, high density polyethylene.

"Suntec HD J240" made by Asahi Kasei Corporation.

(MI=5 g/10 minutes, density=0.97 g/cm$^3$, melting point=132° C.).

Polyethylene resin 6: Metallocene catalyst system, low density polyethylene.

"KERNEL KJ640T" made by Japan Polyethylene Corporation.

(MI=30 g/10 minutes, density=0.88 g/cm$^3$, melting point=58° C.).

Polyethylene resin 7: Ziegler catalyst system, low density polyethylene.

"Suntec LD M6545" made by Asahi Kasei Corporation.

(MI=45 g/10 minutes, density=0.92 g/cm$^3$, melting point=113° C.).

Polyethylene resin 8: Metallocene catalyst system, linear low density polyethylene.

"HARMOREX NH845N" made by Japan Polyethylene Corporation.

(MI=15 g/10 minutes, density=0.91 g/cm$^3$, melting point=120° C.).

Polyethylene resin 9: Ziegler catalyst system, linear low density polyethylene.

"Novatec LL UJ480" made by Japan Polyethylene Corporation.

(MI=30 g/10 minutes, density=0.92 g/cm$^3$, melting point=124° C.).

Polypropylene resin 1: Metallocene catalyst system.

"WINTEC WMG03" made by Japan Polypropylene Corporation.

(MFR=30 g/10 minutes, density=0.91 g/cm$^3$, melting point=142° C.).

Polypropylene resin 2: Ziegler catalyst system.

"Novatec SA04D" made by Japan Polypropylene Corporation.

(MFR=40 g/10 minutes, density=0.91 g/cm$^3$, melting point=165° C.)

Polypropylene resin 3: Metallocene catalyst system.

"WINTEC WFX4T" made by Japan Polypropylene Corporation.

(MFR=7 g/10 minutes, density=0.91 g/cm$^3$, melting point=125° C.).

Antistatic agent 1: "Pelestat 230" made by Sanyo Chemical Industries, Ltd.

(Polyether-polymer type, melting point=165° C.).

Antistatic agent 2: "Pelestat LA120" made by Sanyo Chemical Industries, Ltd.

(Polyether-polymer type, melting point=156° C.).

Antistatic agent 3: "Sankonol TBX310" made by Sanko Chemical Ind. Co., Ltd.

(Polyether-polymer type, melting point=135° C.).

Antistatic agent 4: "Hydrocerol CT3117" made by Clariant Inc.

(Glycerol monostearate, melting point=110° C.)

Examples 1 to 5, Comparative Examples 1 to 3

According to the formulations as described in Table 1 (numeric values in terms of each resin and antistatic agent are represented in terms of parts by weight), each resin and each antistatic agent were blended in a pellet form, and each formulated resin was melted at 230° C. by means of an extruder having a diameter of 30 millimeters, and discharged from a spinneret for obtaining single component fibers. According to a spunbond method, a web is formed on a conveyor by taking up the fibers at speed equivalent to 2,500 m/minute by means of an air sucker. Then, the web was embossed at 125° C. under a linear load of 55 N/mm to obtain each nonwoven fabric having a weight per unit area of 30 g/m$^2$.

A surface resistance value, nonwoven fabric strength and VOC were measured using the obtained nonwoven fabrics according to the methods as described above. The results are shown in Table 1.

TABLE 1

Nonwoven fabric using single component fibers

| | Example 1 | Example 2 | Example 3 | Example 4 | Example 5 | Comparative Example 1 | Comparative Exanple 2 | Comparative Example 3 |
|---|---|---|---|---|---|---|---|---|
| Polyethylene resin 1 | — | 100 | 100 | — | 100 | — | — | — |
| Polyethylene resin 2 | 100 | — | — | 100 | — | — | — | — |
| Polyethylene resin 3 | — | — | — | — | — | — | — | — |
| Polyethylene resin 4 | — | — | — | — | — | 100 | — | — |
| Polyethylene resin 5 | — | — | — | — | — | — | — | — |
| Polyethylene resin 6 | 20 | — | 10 | — | 10 | — | — | — |
| Polyethylene resin 7 | — | — | — | — | — | — | — | — |
| Polyethylene resin 8 | — | 15 | — | 15 | — | — | — | — |
| Polyethylene resin 9 | — | — | — | — | — | 10 | — | — |
| Polypropylene resin 3 | — | — | — | — | — | — | — | 100 |
| Polypropylene resin 2 | — | — | — | — | — | — | 100 | — |
| Antistatic agent 1 | 10 | 5 | 10 | — | 10 | 10 | 10 | 10 |
| Antistatic agent 2 | — | — | — | — | 10 | — | — | — |
| Antistatic agent 3 | — | — | — | 5 | — | — | — | — |
| Antistatic agent 4 | — | — | — | — | — | — | — | — |
| Spinnability (number of times) | 0 | 0 | 0 | 0 | 0 | 0 | 0 | Uncountable |
| Nonwoven fabric strength (N) | 8 | 10 | 10 | 7 | 10 | 8 | 7 | — |
| Surface resistance value | $10^{11}$ | $10^{11}$ | $10^{11}$ | $10^{12}$ | $10^{11}$ | $10^{11}$ | $10^{11}$ | — |
| Total amount of VOC | 5 | 2 | 5 | 5 | 5 | 20 | 147 | — |

Examples 6 to 10, Comparative Examples 4 and 5

According to the formulations as described in Table 2 (numeric values in items of each resin and antistatic agent are represented in terms of parts by weight), each resin and antistatic agent were blended in a pellet form, and each resin was melted at 230° C. with each of a sheath component extruder having a diameter of 30 millimeters and a core component extruder having a diameter of 30 millimeters. The resultant melts were extruded from a spinneret for obtaining a sheath-core type conjugate fiber with a discharge ratio of the sheath component and the core component to be 50% and 50%. According to a spunbond method, a web was formed on a conveyor by taking up the conjugate fiber at speed equivalent to 2,500 m/minute by means of an air sucker. Then, the web was embossed at 125° C. to under a linear load of 55 N/mm obtain each nonwoven fabric having a weight per unit area of 30 g/m$^2$.

A surface resistance value, nonwoven fabric strength and VOC were measured using the obtained nonwoven fabric according to the methods mentioned above. The results are shown in Table 2.

TABLE 2

| Nonwoven fabric using sheath-core type conjugate fibers | | | | | | | | |
|---|---|---|---|---|---|---|---|---|
| | | Example 6 | Example 7 | Example 8 | Example 9 | Example 10 | Comparative Example 4 | Comparative Example 5 |
| Sheath component | Polyethylene resin 1 | 100 | 100 | — | 100 | 100 | — | — |
| | Polyethylene resin 2 | — | — | 100 | — | — | — | — |
| | Polyethylene resin 4 | — | — | — | — | — | 100 | 100 |
| | Polyethylene resin 6 | 10 | 10 | — | 10 | 10 | — | — |
| | Polyethylene resin 8 | — | — | 20 | — | — | — | — |
| | Polyethylene resin 7 | — | — | — | — | — | 10 | 10 |
| | Antistatic agent 1 | 10 | 10 | 10 | — | 10 | 10 | 10 |
| | Antistatic agent 3 | — | — | — | 10 | — | — | — |
| Core component | Polyethylene resin 1 | 100 | 100 | 100 | 100 | — | — | — |
| | Polyethylene resin 6 | — | 10 | — | 10 | — | — | — |
| | Polyethylene resin 4 | 20 | — | 20 | — | — | — | — |
| | Polyethylene resin 7 | 10 | — | 10 | — | — | — | — |
| | Polypropylene resin 1 | — | — | — | — | 100 | 100 | — |
| | Polypropylene resin 2 | — | — | — | — | — | — | 100 |
| Spinnability (number of times) | | 0 | 0 | 0 | 0 | 0 | 0 | 0 |
| Nonwoven fabric strength (N) | | 10 | 10 | 8 | 10 | 12 | 8 | 7 |
| Surface resistance value | | $10^{11}$ | $10^{11}$ | $10^{11}$ | $10^{13}$ | $10^{11}$ | $10^{11}$ | $10^{11}$ |
| Total concentration of VOC | | 5 | 3 | 5 | 3 | 3 | 130 | 300 |

The antistatic fiber of the invention obtained from a constitution of the specific polyolefin resin and the specific high molecular antistatic agent has an excellent high-speed spinnability. Moreover, the nonwoven fabric obtained therefrom has a high strength and a high antistaticity and also an excellent performance of generating no volatile components under a high temperature environment.

INDUSTRIAL APPLICABILITY

As for a polyolefin-based antistatic fiber of the invention and a nonwoven fabric constituted thereof, the nonwoven fabric has a sufficient strength as a packaging material. Furthermore, the nonwoven fabric is thin, and therefore does not take much space in transporting glass substrates for liquid crystal panels or electronic components, and can be used suitably for a cover packaging material or the like around OA equipment that suffer from deposition of dust due to static electricity.

The invention claimed is:

1. A polyolefin-based antistatic fiber, wherein a fiber surface thereof is formed by a polyethylene resin composition that contains: polyethylene resin (A) obtained using a metallocene catalyst, high molecular antistatic agent (B), and 5 to 20 parts by weight of at least one kind of low density polyethylene resin (C) selected from low density polyethylene resin (c1) obtained using a metallocene catalyst and having a melt index, measured at 190° C. under 2.16 kg load, of 10 to 100 g/10 minutes and a density of 0.87 to 0.92 g/cm$^3$, and linear low density polyethylene resin (c2) obtained using the metallocene catalyst and having a melt index, measured at 190° C. under 2.16 kg load, of 10 to 100 g/10 minutes and a density of 0.91 to 0.94 g/cm$^3$ based on 100 parts by weight of polyethylene resin (A), and the total amount, at 90° C. for 30 minute, of volatile organic compounds having up to 20 carbon atoms is 10 μg/g or less, wherein the high molecular antistatic agent (B) is a block copolymer comprising polyethers having a hydrophilic group and is mixed in a ratio of 5 to 30 parts by weight based on 100 parts by weight of the polyethylene resin (A), the polyolefin-based antistatic fiber is a sheath-core type conjugate fiber in which the polyethylene resin composition forms a sheath component completely covering the fiber surface, a core component contains high density polyethylene resin (D) obtained using a metallocene catalyst or Ziegler-Natta catalyst and having a melt index, measured at 190° C. under 2.16 kg load, of 10 to 100 g/10 minutes and a density of 0.94 to 0.97 g/cm$^3$, and, based on 100 parts by weight of the high density polyethylene resin (D), 5 to 20 parts by weight of linear low density polyethylene resin (e2) obtained using the metallocene catalyst or Ziegler-Natta catalyst and having a melt index, measured at 190° C. under 2.16 kg load, of 10 to 100 g/10 minutes and a density of 0.91 to 0.94 g/cm$^3$, a weight ratio of the core component to the sheath component is 50/50, and a weight percentage of (e2) in a combination of (A), (B), (C), (D) and (e2) ranges from 2.38% to 8.3%.

2. The polyolefin-based antistatic fiber according to claim 1, wherein the polyethylene resin (A) is a high density polyethylene having a density of 0.94 to 0.97 g/cm$^3$.

3. The polyolefin-based antistatic fiber according to claim 1, wherein a melt index, measured at 190° C. under 2.16 kg load, of the polyethylene resin (A) is 10 to 100 g/10 minutes.

4. The polyolefin-based antistatic fiber according to claim 1, wherein a melting point of the core component is higher than a melting point of the sheath component by 10° C. or more in the melting point measured at a heating rate of 10° C./minute by means of a differential scanning calorimeter (DSC).

5. The polyolefin-based antistatic fiber according to claim 1, wherein the fiber is a continuous fiber.

6. The polyolefin-based antistatic fiber according to claim 5, wherein the fiber is manufactured by any one of a manufacturing method, selected from a spunbond method or a meltblown method.

7. A nonwoven fabric obtained using the fiber according to claim 1.

8. The nonwoven fabric according to claim 7, wherein a surface resistance value of the nonwoven fabric is in the range of $10^3$ to $10^{13}\Omega$.

9. A composite nonwoven fabric, wherein second layer is laminated on the nonwoven fabric according to claim 7.

10. A formed body obtained using the nonwoven fabric according to claim 7.

11. A composite nonwoven fabric, wherein second layer is laminated on the nonwoven fabric according to claim 8.

12. A formed body obtained using the nonwoven fabric according to claim 8.

13. A formed body obtained using the composite nonwoven fabric according to claim 9.

14. The polyolefin-based antistatic fiber according to claim 1, wherein the linear low density polyethylene resin (e2) comprises a copolymer with an α-olefin of 3 to 12 carbon atoms based essentially on ethylene.

* * * * *